US008250831B2

(12) United States Patent
D'Amico

(10) Patent No.: US 8,250,831 B2
(45) Date of Patent: Aug. 28, 2012

(54) METHOD FOR INSTALLING WINDOW BETWEEN JOISTS

(76) Inventor: Craig D'Amico, Milford, PA (US)

( * ) Notice: Subject to any disclaimer, the term of this patent is extended or adjusted under 35 U.S.C. 154(b) by 0 days.

(21) Appl. No.: 13/168,920

(22) Filed: Jun. 24, 2011

(65) Prior Publication Data

US 2011/0308194 A1 Dec. 22, 2011

Related U.S. Application Data

(62) Division of application No. 12/234,178, filed on Sep. 19, 2008, now abandoned.

(51) Int. Cl.
*E04B 1/00* (2006.01)

(52) U.S. Cl. ..... 52/745.15; 52/171.1

(58) Field of Classification Search ..... 52/204.1, 52/171.1, 210, 200, 302.6, 107, 745.15
See application file for complete search history.

(56) References Cited

U.S. PATENT DOCUMENTS 2,134,142 A * 10/1938 Orear ..... 454/346
2,710,431 A * 6/1955 Griffon ..... 52/204.5
3,090,613 A * 5/1963 Bechtold ..... 49/325
4,501,194 A * 2/1985 Brown ..... 454/354
4,520,604 A * 6/1985 Halsey et al. ..... 52/200
4,619,086 A * 10/1986 Naka ..... 52/205
5,150,983 A * 9/1992 Bogenhagen ..... 403/402
6,918,216 B2 * 7/2005 Hoy et al. ..... 52/200
7,061,171 B2 * 6/2006 Jung ..... 313/470
7,497,773 B1 * 3/2009 Schmidt ..... 454/354
2001/0034986 A1 * 11/2001 Thomas et al. ..... 52/211
2003/0068972 A1 * 4/2003 Snyder ..... 454/330
2005/0000173 A1 * 1/2005 Lindgren et al. ..... 52/200
2006/0265978 A1 * 11/2006 Stein et al. ..... 52/204.5
2009/0031649 A1 * 2/2009 Nemazi et al. ..... 52/200

* cited by examiner

*Primary Examiner* — Branon Painter
(74) *Attorney, Agent, or Firm* — Blvestone Technical, LLC; Eric A. Langberg

(57) ABSTRACT

Disclosed is a method for installing a window or other fenestra-mounted object between joists in a structure having a ceiling. The method for installing a fenestra-mounted object into a structure having a ceiling supported by joists, comprising the steps of: creating a void between two joists of the structure, with at least some portion of the void being above the plane of the bottom of the joists; creating an opening in an exterior covering of the structure aligned with the void such that light or air external to the structure may enter the structure through the opening and the void; and installing a fenestra-mounted object in the void. Trim or a preformed trim component may be installed around the interior and exterior portions of the fenestra-mounted object to give a finished appearance.

19 Claims, 4 Drawing Sheets

METHOD FOR INSTALLING WINDOW BETWEEN JOISTS

RELATED PATENTS

This application claims the benefit, under 35 U.S.C. section 121, of U.S. patent Ser. No. 12/234,178, filed Sep. 19, 2008, entitled "Method and Kit for Installing Window Between Joists", which is incorporated by reference herein in its entirety.

BACKGROUND OF THE INVENTION

Windows provide access through walls for bringing sunlight into structures. Windows that open serve the additional function of providing ventilation to the structure. Windows are available in a large variety of sizes and styles to suit different applications, including fixed windows, casement windows, sash windows, bow windows, bay windows, and skylights. For a typical installation in a framed structure, such as a house, an opening is formed in the wall by leaving out or removing studs. The section of wall where the studs are removed is supported by installation of a header over the window to keep the top plate from sagging from the weight of the walls and roof above the window. Installing an additional window after a structure is completed requires major renovation to frame in the necessary support structure prior to installation of the window.

On top floors, especially where the ceiling is installed parallel to the rafters, such as a cathedral style ceiling, skylights may be installed in the roof structure to allow sunlight to enter the room. Skylights offer some advantages over wall mounted windows since they are mounted higher up in the room, providing a more direct path for the sun's light to enter the room. Some skylights or ceiling-mounted openings also provide for ventilation by opening to allow hot air from inside the room to escape to the outside of the structure.

On the lower stories of a multi-story dwelling, however, skylights are of no lighting benefit unless a light corridor is established to allow the light to pass through the floor of the upper story and through the ceiling of the lower story. This requires an opening in the ceiling of the lower story and corresponding loss of usable floor space in the upper story. Another option is to completely remove a portion of the ceiling on the first floor so the walls extend from the first floor all the way up to the ceiling of the second story. This results in a much more significant reduction of second story floor space and creates a loft effect for a portion of the second story. What is needed is a way to bring more sunlight into a lower story room without the complexity of light columns for skylights, the loss of floor space on the upper stories, or the need for complex framing changes.

Lumber used in the construction industry is commonly called by its rough cut dimensions prior to drying, planning, or treatment. The actual finished lumber size is smaller. For example, lumber typically referred to as "2×4" currently measure 1.5 inches thick×3.5 inches wide as purchased. Lumber is available in a variety of lengths, however references to lumber length is not relevant for this patent specification. For this patent specification, rough cut sizes will be used with the understanding by one skilled in the art that actual physical dimensions of the lumber will vary.

While ordinary frame construction typically uses lumber, newer building materials, often referred to as "engineered lumber", are also employed in today's construction methods. Engineered lumber includes, but is not limited to, manufactured wood I-beams, finger-jointed lumber, manufactured trusses, glulams, and laminated veneer lumber. This specification shall refer to standard lumber, but is will be understood by one skilled in the art that alternate materials or construction methods that serve the same function are considered equivalents and within the scope of the invention.

In a typical house of ordinary frame construction, the walls are erected using plates and studs, typically of 2×4 or 2×6 lumber. A bottom plate of lumber is laid flat and is attached to the decking structure. Studs then extend vertically from the bottom plate to the top plate, which is typically constructed of two layers of lumber laid flat across the top of the studs and referred to as a double top plate. Single top plates may be found in older structures and are occasionally used today, but the double top plate is more common. The top and bottom plates are disposed along the perimeter of the structure, except where doors are to be installed, in which case the bottom plate is eliminated and the top place is reinforced by a lintel, typically referred to as a header. The studs are left out of the opening to permit the installation of the door. Where windows are to be installed, the window opening is typically framed using a header to support the top plate. A box is built from lumber of the correct size to permit installation of the window. The space above and below the box typically has short studs extending from the box frame to the lower plate or up to the header. These provide convenient nailing points for the interior and exterior wall surfaces.

When constructing the second story of the house, joists are set on edge so they rest on the upper surface of the top plate. Standard joists in a multistory house are 2×10 and 2×12 lumber however other sized may be employed and be within the scope of the invention. The joists are set at a standard spacing, typically sixteen inches center to center or twenty-four inches center to center. On the upper surface of the joists, decking is laid to form the base for the second story floor. On the underside of the joists, the first story ceiling is installed, typically drywall, sheetrock or other similar material. A dropped ceiling may also be installed using a lightweight frame hung from the joists, with tiles laid into the framework.

Joists are installed running around the entire perimeter of the top plate to form a box. On the walls parallel to the floor joists, additional joists may be added that rest completely on the top plate, with their outer surfaces being flush with the outside edge of the top plate and the studs. On the walls perpendicular to the direction of installation of the floor joist, joists called "rim joists" are installed with their inside flat surface abutting the ends of the floor joists and with their outside edge flush with the outer edge of the studs and top plate.

A typical basement wall is constructed from poured concrete, cast concrete panels, or cinder blocks. At the top of the basement wall, a sill plate is laid to form the basis for the framing above.

SUMMARY OF THE INVENTION

The present invention is directed to a method for installing a window, vent, or fan above the ceiling in a structure to increase the amount of sunlight or ventilation available to the interior of the structure below the ceiling. This invention may be practiced during new construction or as a renovation to existing construction.

An object of this invention is to provide a method for installing a window to bring additional sunlight into the lower story or stories of a multistory structure, including the basement, without the loss of floor space in the stories above.

Another object of this invention is to provide a method of installing an operable window or other element to increase ventilation by allowing hot air near the ceiling to escape to the outside of the structure.

Another object of this invention is to provide a method for installing a window, vent, or fan without the need for additional structural framing.

Another object of this invention is to provide a kit to facilitate the installation of a window using the disclosed method.

In the description that follows, typical construction for a house will be used as an example to teach the invention. It will be obvious to one skilled in the art that the invention may be practiced in similar fashion and be within the scope of the invention where construction techniques or materials differ from those described.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of at least one embodiment of the invention.

DETAILED DESCRIPTION OF EMBODIMENTS OF THE INVENTION

For this specification, a window, vent, or fan will be referred to as a "fenestra-mounted object". It should be understood by one skilled in the art that although the examples in this specification may make reference to a window, any fenestra-mounted object may be substituted and be within the scope of this patent. It will be recognized by one skilled in the art that installation of a fenestra-mounted object according to the disclosed method does not require structural changes to the structure in which the object is installed.

Figure 1:
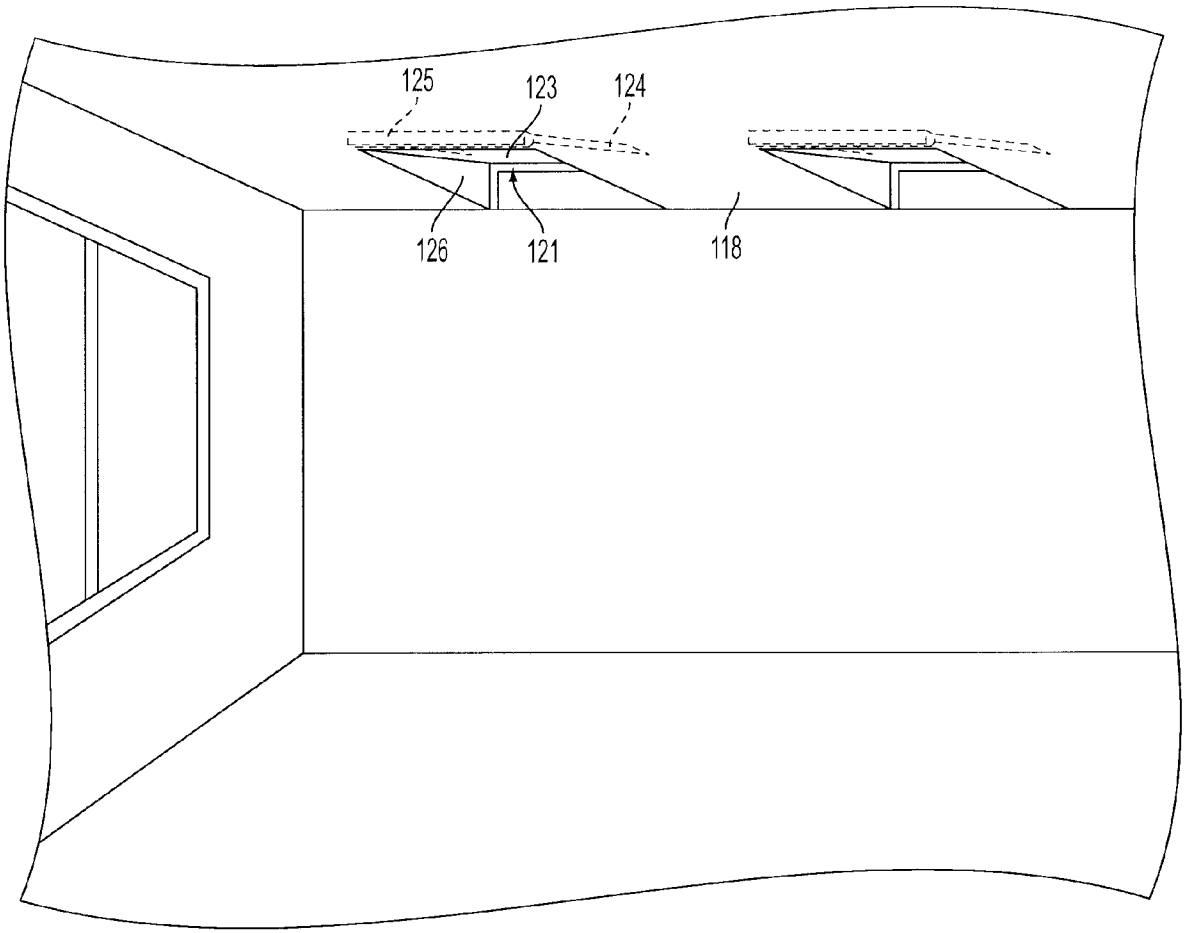
FIG. 1—View of windows after installation according to the disclosed method

FIG. 1 illustrates an interior view of a room after installation of window 121 employing the invented method and kit. The window 121 is installed above the plane of the ceiling 118 by removing a section of the ceiling 118 between the joists, not shown. To aid the installation of surface treatment 126 and covering 123 after the window 121 is installed, a pair of nailers 124 are affixed at an angle along the opposing interior surfaces of the joists. Cross-nailer 125 is attached on each end to the joists so it spans the distance between the joists and forms an attachment structure for the ceiling 118 at the edge of the removed section as well as for a covering 123 to be applied after the window 121 is installed. Surface treatment 126 may be applied to both joists to give a finished appearance. Covering 123 is attached to the nailers 124 and cross-nailer 125 to form the upper surface of a recess. Corners formed by the ceiling 118 and the surface treatment 126 and covering 123 may be finished using standard corner treatments including, but not limited to, corner bead, drywall tape and spackling paste or other similar corner treatments as is known in the art.

Figure 2:
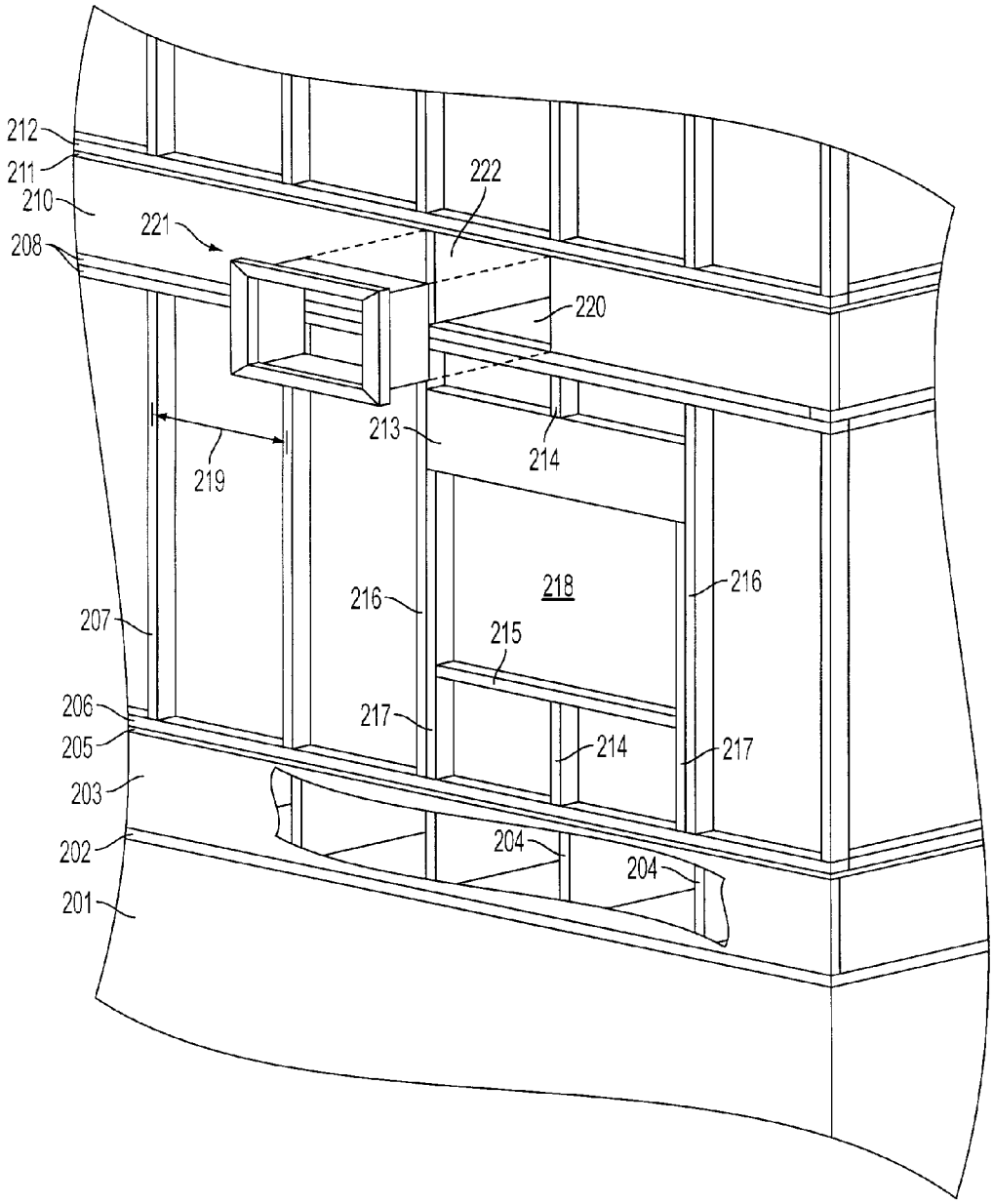
FIG. 2—Typical Building Construction

A section view representative of the typical structure in an ordinary frame building is represented in FIG. 2. The first floor is built by installing a sill plate 202 to the foundation wall 201. Joists 204 rest on and are typically fastened to the sill plate 202 on one end, with the other end resting on a sill plate on an opposite basement wall or on a beam, not shown, run under the first floor structure. A rim joist 203 is installed along the edge of the sill plate 202, perpendicular to the joists 204, resting on the sill plate 202 and against the ends of the joists 204. The rim joist 203, caps the ends of the joists 204 and along with the outermost joists forms a box around the perimeter of the first story floor structure. Decking 205 is laid on and secured to the floor joists to form the subfloor. The combination of floor joists 204, rim joists 203, and decking 205 form a platform for supporting the first story floor, upon which the first story walls are constructed. A bottom plate 206 runs around the perimeter of the structure and serves as the bottom attachment point for the various studs 207. The studs 207 are attached at the upper end to a top plate 208. It is common to have a top plate formed from two layers of lumber 208 and commonly referred to as a double top plate. Joists 222 are laid on the upper surface of the top plate 208 to form the support for the second story floor and first story ceiling. A rim joist 210 is installed perpendicular to and caps the second story joists 222. Decking 211 is secured to the second story joists 222 and a bottom plate 212 installed for the second story. Bottom plate 212 is fastened to the decking 211 and provides the bottom attachment point for the studs above. The sequence of platform, bottom plate, studs, and top plate is repeated for each story of the structure.

A typical window opening 218 is constructed via the installation of king studs 216, trimmer studs 217, header 213, cripple studs 214, and window sill 215. The header 213 supports the open space while the cripple studs 214 provide a nailing surface for the interior and exterior wall coverings, not shown.

The studs 207 are typically set at a standard spacing 219, with a very common spacing being sixteen inches from the center of one stud to the center of the next stud, commonly referred to as sixteen inches on center (OC) or sixteen OC. Other standard spacing may be employed, for example, twelve inches on center or twenty-four inches on center. Joists 204 and 222 typically follow the same center to center spacing as the studs 207 and are typically centered vertically over the studs 207 as shown in FIG. 2.

In a first embodiment, the invention is employed to install a window 221 in an existing structure. The existing joists 222 are located and a section of the ceiling covering is removed between two joists proximate to each other. The section of the rim joist 210 between the opposing faces of the joists is removed to form a void 220 bounded on either side by a joist 222, bounded on the top by the lower surface of the decking 211 from the story above and bounded on the bottom by the top surface of the top plate 208 from the walls of the story below. An opening in the exterior wall covering, not shown, is created in the same location and same size as the previously described void 220. A window 221 with the proper dimensions is fitted into the void 220 and secured in place. Exterior trim, not shown, may be added to the exterior wall covering or may be integral to the window assembly.

Figure 3:
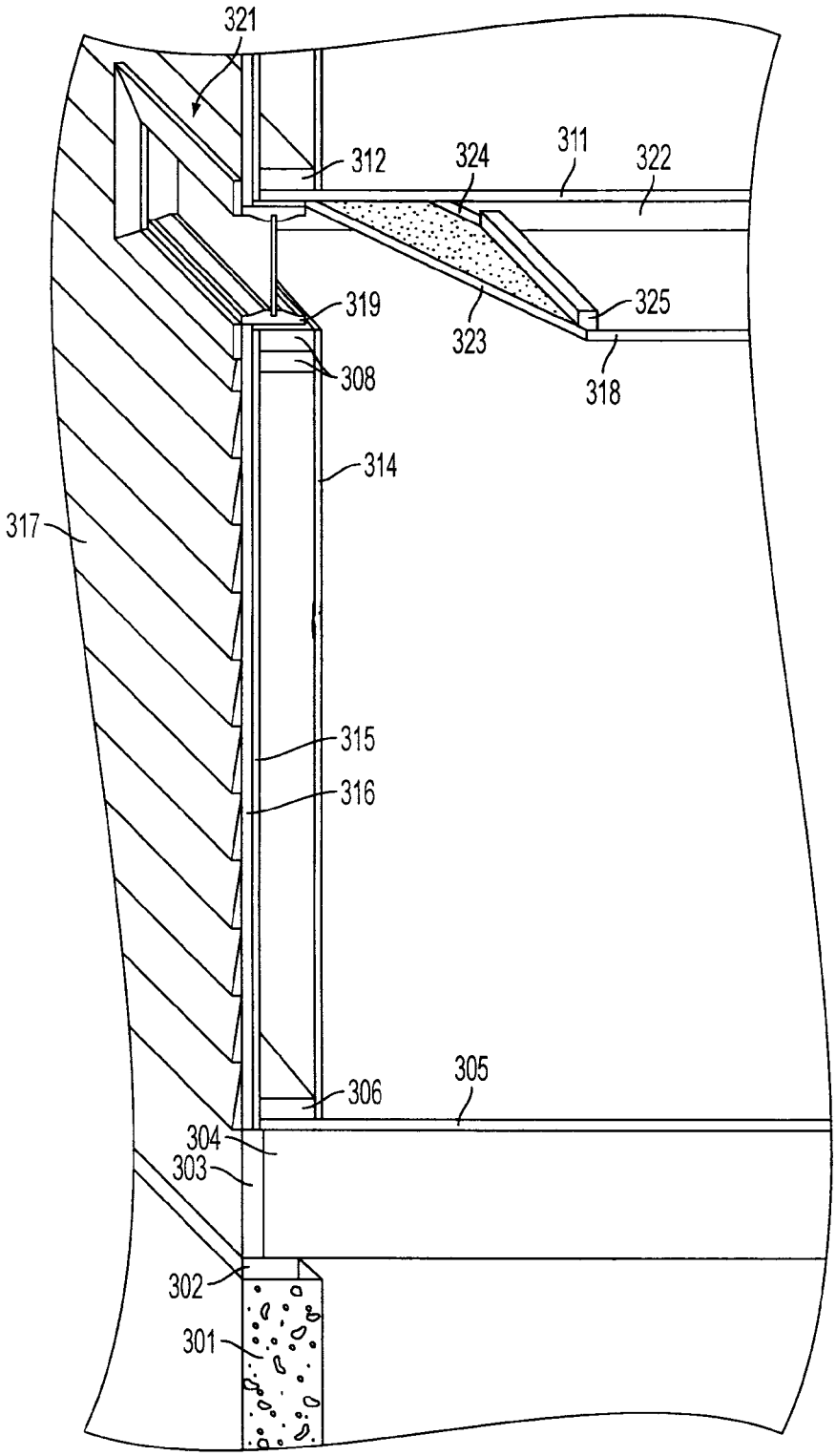
FIG. 3—Cutaway through structure and window installed according to the disclosed method FIG. 4—Side cutaway of window installed according to the disclosed method

FIG. 3 shows a cutaway of a typical wall structure with interior and exterior coverings. As described earlier, the wall is built upward from foundation wall 301, sill plate 302, joists 304, rim joist 303, decking 305, bottom plate 306, studs, not shown, top plate 308, joists 322, decking 311, bottom plate 312. Window 321 is installed with the bottom of frame 319 resting on the uppermost surface of top plate 308. Exterior walls are typically covered with sheathing 315, typically plywood or other sheathing material, attached to the studs. Foam board 316 may be attached to the sheathing. It is also known when installing siding 317, to cover the exterior walls with foam board 316 attached directly to the studs without installing a layer of wood sheathing 315. Other materials, not shown, may be used in forming the exterior treatments, such as but not limited to barrier layers and spacers. Exterior siding materials 317 are then applied exterior to the sheathing 315 or foam board 316.

Interior wall covering 314 and ceiling covering 318 may be chosen from a variety of materials and methods, as is known in the art, with a common material for new construction being drywall and related types of wall board.

Interior trim may be added by attaching covering 323, typically the same material as the ceiling covering, to nailers 324 and cross-nailer 325. The exposed portion of the joists 322 below covering 323 may have a surface treatment applied using the same material as covering 323 or they may be stained, painted, or provided other surface treatments as is known in the art. This creates an attractive recess in the ceiling leading up to the interior surface of the window structure.

Figure 4:
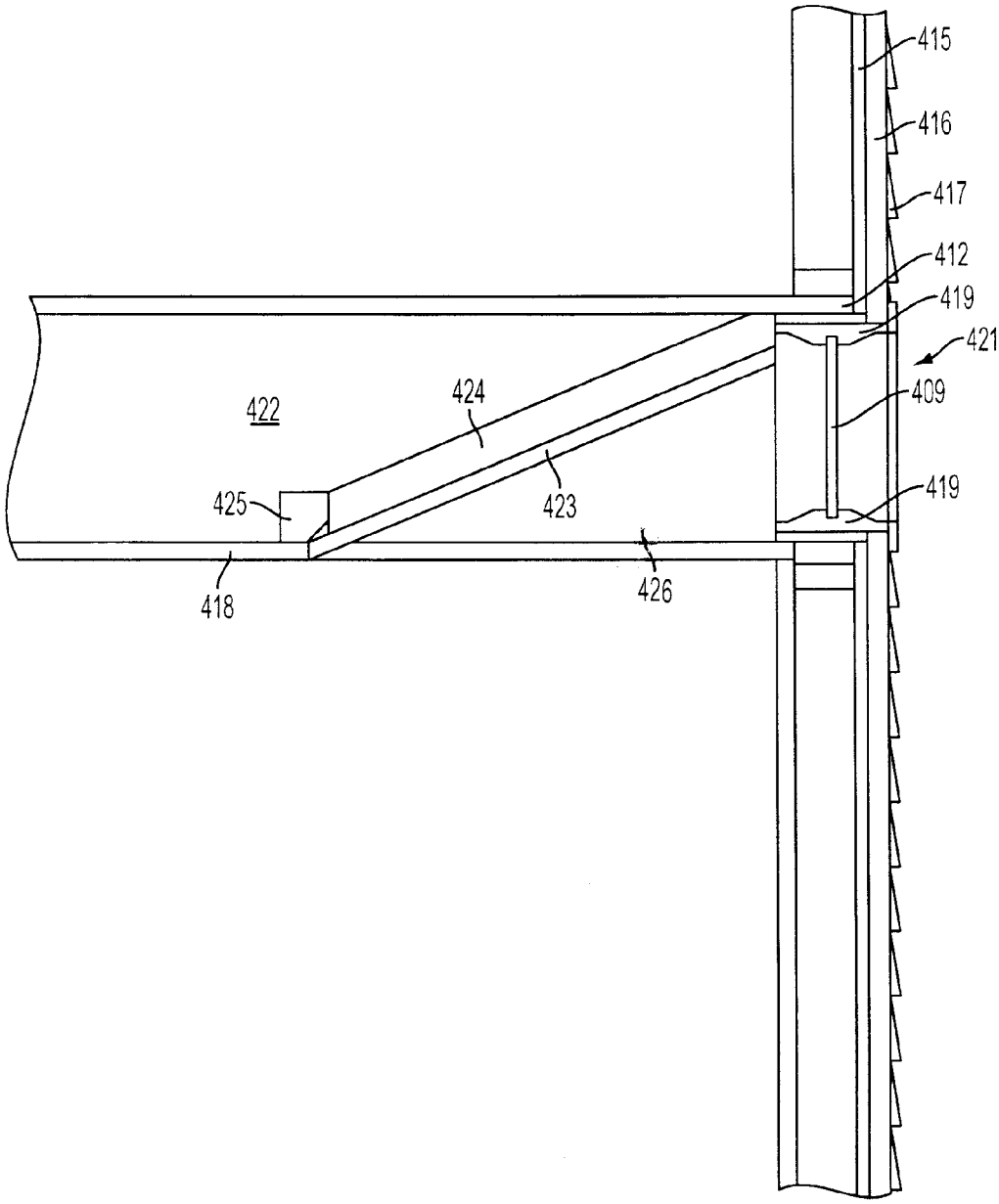

FIG. 4 shows a side cutaway through a wall section and window 421 installed according to the disclosed method. Window 421 is shown with glass 409 installed in a frame 419 which can be installed as a unit into the void in the wall created by the absence or removal of a section of the rim joist, and removal or absence of sheathing 415, foam board 416, and exterior siding 417, as described earlier. Window 421 may be made as a fixed window or an operable window that would open to allow ventilation. Window 421 may also include a screen. For ease of installation, it is suggested by the inventor that window 421 be a pre-manufactured assembly, however it is possible to frame window 421 directly into the structure and still be within the scope of the invention. Window 421 may include an outer flange to aid in exterior trim by covering sheathing 415, if present, or foam board 416, if present. Trim may be applied around the exterior of window 421 to match with exterior siding 417, as is known in the art.

Cross-nailer 425 is installed perpendicular to joist 422 and forms an attachment surface for ceiling 418 and covering 423. A nailer 424 is installed on an angle to 422, sloping from the bottom of the upper story decking 412 near the top of the window 421 to cross-nailer 425 and forms an attachment surface for covering 423. Covering 423 and ceiling 418 may be of the same material, such as, but not limited to, drywall. The exposed portion of the joist indicated by 426 may be painted, stained, or covered with the same material used for the ceiling and covering 423.

In an embodiment, the invented method is employed to install a fenestra-mounted object in an existing structure to permit air flow into or out of the structure. The existing joists are located and a section of the ceiling covering removed between two joists proximate to each other. The section of the rim joist between the opposing faces of the joists is removed to form a void bounded on either side by a joist, bounded on the top by the lower surface of the decking from the story above and bounded on the bottom by the top surface of the top plate from the walls of the story below. An opening in the exterior wall covering is created in the same location and same size as the previously described void. A vent with the proper dimensions is fitted into the void and secured in place. Exterior trim may be added to the exterior wall covering or may be integral to the vent. Interior trim may be added to create an attractive recess in the ceiling leading up to the interior surface of the vent mounting structure. The opposite facing surfaces of the joists may be painted or other covering may be applied to give a finished appearance.

In an embodiment, interior trim includes the addition of fastening strips or nailers 424 attached to the joists on an angle sloping from approximately the top of the joist at the end nearest the void to approximately the bottom of the joist at the end nearest the interior most portion of the ceiling opening. An additional fastening strip or cross-nailer 425 may be installed cross-wise, spanning the joists near the edge of the ceiling opening to provide for attachment and support of the ceiling covering. The sloping fastening strips are used to secure a covering in place between the joists. Corner bead may be installed where the sloping covering meets with the rest of the ceiling covering to improve the overall appearance.

In an embodiment, a preformed trim component is installed, which creates the recess sloping from the top of the void to a line formed by the intersection of the plane of the ceiling and the bottom of the trim component. The trim component would most commonly be ramp shaped, having a triangular cross-section, but other cross-sectional forms including, but not limited to, parabolic, rectangular, polygonal, or curved may be employed. The preformed trim component may be made from a variety of materials including, but not limited to, plastic, metal, wood, foam, or even a soft material attached to a frame. Combinations of materials may also be used to create the preformed trim component. One example would be a large, substantially wedge-shaped injection molded part that could be installed into the open area of the ceiling after the window, vent, or fan is installed as described previously. The trim component would eliminate the need to cut and install drywall or other surface coverings to cover up the joists and decking exposed when removing a section of the ceiling to install the window according to the disclosed method. The trim component would replace the surface treatments 126 and covering 123 shown in FIG. 1, while presenting the same finished appearance.

In an embodiment, the invention is employed to install a fenestra-mounted object into new construction. During framing of the platform, a void is created in the rim joist between two adjacent joists at each location where the fenestra-mounted object is desired. Attachment strips, such as nailers, may be installed during construction to aid in the installation of surface coverings and trim materials. An opening is created in the outer wall covering to enable installation of the fenestra-mounted object into the void.

In an embodiment, a kit is supplied for aiding installation of a fenestra-mounted object according to the invented method. The kit may include the fenestra-mounted object, a template for marking the opening needed in the ceiling to a predetermined size, precut side fastening strips or nailers for attachment of covering materials and/or trim materials, a precut cross-nailer or additional parts for securing the fenestra-mounted object, and instructions for installing the fenestra-mounted object according to the invented method.

In an embodiment, a fenestra-mounted object is installed which is longer than the space between two adjacent joists. In this embodiment, a section is removed from one or more joists of sequentially proximate joists, leaving a full length joist on either side of the group of one or more shortened joists. A support structure comprising a header and joist hanger(s) is built to support and secure the remaining section of the shortened joist(s), as is known in the art. The header is secured to the outer two full length joists, with the shortened joist(s) abutting the header on one side. The outer two full length joists may be reinforced by various means as is known in the art, for example attaching an additional joist to each of the outer joists. The shortened joist(s) is secured to the header by means of a joist hanger, as is known in the art. The resulting structure forms an open area in the ceiling which is greater than the center to center spacing of adjacent joists. Additional support may also be employed to support the floor of the upper story, as is known in the art, for example, installing a crossmember of lumber secured to the outer two joists against the upper story decking to reinforce the decking. While this approach may be employed in existing construction, it is simpler to employ during new construction or large scale renovations since the required framing to properly support the floor above will be easier to implement before the ceiling covering is in place.

I claim:

1. A method for installing a fenestra-mounted object into a structure having at least a ceiling supported by joists, comprising the steps of:

(a) creating a void between a first horizontal ceiling joist and a second horizontal ceiling joist, the first horizontal ceiling joist and the second horizontal ceiling joist each having a bottom surface closest to a foundation of the structure, a top surface farthest away from the foundation, and first and second vertical side surfaces perpendicular to the top and bottom surfaces, and wherein the void is created by removal of a section of a rim joist between the first horizontal ceiling joist and the second horizontal ceiling joist, with at least a portion of the void being above the bottom surface of said first horizontal ceiling joist;

(b) creating an opening in the covering of an exterior vertical wall of the structure, aligned with the void; and (c) installing a fenestra-mounted object in the void.

2. The method of claim 1 wherein the first horizontal ceiling joist and the second horizontal ceiling joist are adjacent to each other.

3. The method of claim 1 wherein a bottom perimeter of the void is created above a top plate of a wall structure.

4. The method of claim 1 wherein a top perimeter of the void is created parallel to or below a top surface of the first joist.

5. The method of claim 4 wherein the void has a perimeter bounded on a first side by a first side surface of the first joist and bounded on a second side by a second side surface of the second joist and bounded on a bottom side by a top surface of a top plate of a wall.

6. The method of claim 1 wherein the structure contains a decking material affixed to the top surface of the first joist, the decking material having a bottom face proximate to the top surface of the first joist, and a top face on the opposite side of the decking material from said joist, the decking material and horizontal ceiling joists forming the support for a second story floor such that the fenestra-mounted object is installed in an area defined on the bottom by a top surface of a top plate, defined on the top by the bottom face of the decking material, defined on a first side by a first side surface of the first joist, and defined on a second side by a second side surface of the second joist, and wherein the step of installing a fenestra mounted object in the void is performed such that the fenestra-mounted object protrudes through the wall.

7. The method of claim 1 further comprising the step of removing at least one section of the ceiling between the joists.

8. The method of claim 1 wherein no additional structural framing elements are required to install the fenestra-mounted object.

9. The method of claim 1 further comprising the step of attaching at least one covering to an interior portion of the structure between the joists, such that a recess is formed in the ceiling to allow the fenestra-mounted object to be visible from below the ceiling.

10. The method of claim 9 wherein the recess is substantially wedge shaped, declining from a line proximate to a top surface of the fenestra-mounted object to a line proximate to a plane formed by a bottom surface of the ceiling.

11. The method of claim 9 further comprising the step of installing a nailer to at least one joist to aid the installation of the at least one covering.

12. The method of claim 9 wherein the at least one covering is a preformed trim component.

13. A method for installing a fenestra-mounted object into a finished structure having a ceiling supported by joists, comprising the steps of:

(a) locating within the ceiling a first horizontal ceiling joist and a second horizontal ceiling joist adjacent to the first horizontal ceiling joist;

(b) removing a section of the ceiling covering between the first horizontal ceiling joist and the second horizontal ceiling joist;

(c) removing a section of a rim joist between the first horizontal ceiling joist and the second horizontal ceiling joist, thus creating a void bounded on either side by a joist, bounded on the top by a lower surface of decking from a story above the ceiling, and bounded on the bottom by a top surface of a top plate of a vertical exterior wall supporting the joists;

(d) creating an opening in an exterior surface covering of the structure aligned with the void; and (e) installing a fenestra-mounted object through the opening and into the void.

14. The method of claim 13 further comprising the step of attaching at least one covering to an interior portion of the structure such that a recess is formed in the ceiling to allow the fenestra-mounted object to be visible from below the ceiling.

15. The method of claim 13 wherein the covering is a preformed trim component.

16. A method for installing a fenestra-mounted object during construction of a structure, wherein the completed structure will have a ceiling supported by joists and an outer vertical wall, and wherein the method comprises the steps of:

(a) installing a first horizontal ceiling joist and a second horizontal ceiling joist, each having a bottom surface closest to a foundation of the structure, such that the bottom surface of each horizontal ceiling joist rests on a top surface of a top plate of the outer vertical wall at one end with each horizontal ceiling joist extending horizontally into the structure perpendicularly to the outer wall;

(b) creating a void between the first horizontal ceiling joist and the second horizontal ceiling joist, that extends from the interior of the structure to the exterior of the structure, by not installing a rim joist at the end of the joists resting on the top plate or by removal of a section of a rim joist between the first horizontal ceiling joist and the second horizontal ceiling joist;

(c) creating an opening in any exterior vertical wall surface coverings of the structure, aligned with the void; and (d) installing a fenestra-mounted object in the opening.

17. The method of claim 16 further comprising the step of installing a surface covering between the first horizontal ceiling joist and the second horizontal ceiling joist, the surface covering extending from an area proximate to a top surface of the fenestra-mounted object to an area proximate to a bottom surface of a ceiling covering, such that the surface covering forms a recess in the ceiling of the structure and such that the fenestra-mounted object is visible from below the ceiling.

18. The method of claim 16 wherein the first joist and the second joist are installed such that a first end of said first joist and a first end of said second joist are flush with an exterior surface of the top plate.

19. The method of claim 16 wherein the surface covering is a preformed trim component.

* * * * *